US005520383A

United States Patent [19]

Amagai et al.

[11] Patent Number: 5,520,383

[45] Date of Patent: May 28, 1996

[54] APPARATUS FOR CONTROLLING TRANSPORTATION OF PRINTED MATERIALS

[75] Inventors: Tamio Amagai; Satomi Okita, both of Kawasaki, Japan

[73] Assignee: Fujitsu Limited, Kanagawa, Japan

[21] Appl. No.: 369,487

[22] Filed: Jan. 6, 1995

[30] Foreign Application Priority Data

Mar. 16, 1994 [JP] Japan ..... 6-044563

[51] Int. Cl.[6] ..... B41J 13/00

[52] U.S. Cl. ..... 271/265.01; 271/265.02; 271/272; 400/582; 400/596

[58] Field of Search ..... 400/582, 596; 226/27, 30, 42, 111, 25, 45; 271/270, 265.01, 265.02, 272

[56] References Cited

U.S. PATENT DOCUMENTS

| | | | |
|---|---|---|---|
| 3,709,416 | 1/1973 | Kunz | 226/27 |
| 3,844,463 | 10/1974 | Copp | 226/42 |
| 4,591,969 | 5/1986 | Bloom et al. | 400/582 |
| 4,852,785 | 8/1989 | Betterdorf et al. | 101/181 |
| 5,045,134 | 9/1991 | Schenker et al. | 226/11 |

*Primary Examiner*—John S. Hilten

*Attorney, Agent, or Firm*—Nikaido Marlmelstein Murray & Oram

[57] ABSTRACT

An apparatus for controlling the transportation speed of a sheet, such as a printed sheet or manuscript, includes a sheet transportation system and a speed controller. The transportation system includes a single drive motor and a plurality of rollers driven by the single motor and arranged in such a manner that a sheet to be transported is held by the rollers one after another. The speed controller includes a sensor for detecting the position of the sheet. The number of rollers which hold the sheet is determined. A speed controller provides the motor with a designated speed command calculated on the basis of the numbers of rollers, so that the actual sheet transportation speed is always constant regardless of the numbers of rollers which hold the sheet.

9 Claims, 6 Drawing Sheets

APPARATUS FOR CONTROLLING TRANSPORTATION OF PRINTED MATERIALS

BACKGROUND OF THE INVENTION

1. Field of the Invention

This invention relates to an apparatus for controlling the transportation of printed materials, such as documents, manuscripts, printed sheets or the like sheet media, in a printer, an image reader, an information processing machine and the like.

2. Description of the Related Art

In a printer in which printed materials or paper sheets (hereinafter referred to as "sheets") are transported to a printing section to be printed, or in an image reader in which sheets are transported to an image reading section where data on the sheets are read, a plurality of rollers are provided to transport the sheets and these rollers are arranged in such a manner that the sheet is always in contact with at least one roller. In general, these rollers are driven or rotated by a single motor in order to reduce the cost.

In such a sheet transporting apparatus, the number of rollers which directly transport the sheet, i.e., the number of rollers which are in contact with the sheet changes in accordance with the position of the sheet. Therefore, if the driving capacity or torque of the motor is relatively small, and the load exerted on the motor changes according to the number of rollers which directly contact the sheet, the sheet transporting speed will also change.

Thus, an apparatus, in which a change in the sheet transporting speed due to the above-mentioned causes is prevented, has long been required so that print quality or reading accuracy can be maintained.

In FIGS. 5*a* and 5*b*, a printer or image reader with a conventional sheet transporting apparatus, as known in the prior art, is shown in cross-section. The sheet transporting apparatus includes a pair of rollers 1 and 1' and a pair of rollers 2 and 2' having, each having a same diameter, for transporting a sheet 4 and a head 5 for scanning the sheet in a line direction (i.e., a direction perpendicular to the drawing) to carry out a printing or image reading operation.

As shown in FIG. 5*a* and FIG. 5*b*, each of the two pairs of rollers includes a drive roller 1 or 2 and a pinch roller 1' or 2' arranged opposite to the drive roller. The two drive rollers 1 and 2 have the same diameter and are operatively connected to a motor 3 by means of a rotating shaft of a belt 6. When the motor 3 rotates, the two drive rollers 1 and 2 rotate at the same speed. Thus, the sheet 4 is first held and transported by the pair of rollers 1 and 1' and then by the pair of rollers 2, 2', in turn, at a predetermined speed.

The sheet which is fed to and held by the rollers 1 and 1' is, (1) transported toward the head 4 by only one pair of rollers 1 and 1', then (2) transported by two pairs of rollers 1, 1' and 2, 2', and finally (3) transported only by a single pair of rollers 2 and 2' and discharged. During the transportation, the sheet is scanned and printed (or read) by the head 5.

It is preferable that the motor 3 is a pulse motor or a direct current motor which can be driven at a certain exact speed on the basis of an instruction.

In the above-mentioned conventional sheet transporting apparatus, the relationship between the sheet transporting speed V1 when the sheet is held by and transported only by the rollers 1 and 1' (or rollers 2 and 2') and the sheet transporting speed V2 when the sheet is held by and transported by both pairs of the rollers 1, 1' and 2, 2' is defined, in general, as follows.

$$V1 \geqq V2$$

The reason is that the load on the motor increases if the number of rollers which hold the sheet increases. Thus, the motor 3 will not be able to rotate at a speed in accordance with an instruction, as shown in FIG. 6 in which a variation in transportation speed is shown. At a certain speed, if the sheet is progressively held and transported by roller 1, roller 2, roller 3 and so forth, the sheet speed will be reduced one in steps. Such a phenomenon has been confirmed by experiment and experience.

Therefore, if V1 is larger than V2 (V1>V2), the printing pitch or the reading pitch will change during a printing or reading operation. Thus, the printing or reading quality will be reduced. If the driving capacity of the motor is increased, such problems will be solved. However, according to such a solution, a motor will become more expensive. Also, if a larger motor is used, the noise from the motor will increase.

If the speed of the sheet is continuously monitored and the motor is feed-back controlled in accordance with the monitored speed, a speed monitoring encoder or the like will be necessary and therefore it will cause an increase in the cost, although such a drive mechanism is required to be as simple as possible.

SUMMARY OF THE INVENTION

An object of the present invention is to provide a simple apparatus for transporting a sheet in which the transportation speed can be maintained constant even if the paper, such as a printed sheet or a manuscript, is transported by a plurality of rollers driven by a single drive source.

According to the present invention, there is provided an apparatus for controlling the transportation speed, said apparatus comprising:

- a transportation system which includes a single drive source and a plurality of rollers rotationally driven by said single drive source and arranged in such a manner that a sheet to be transported is held by said rollers one after another;
- means for controlling said single drive source, said means comprising:
  - means for detecting the position of said sheet;
  - means for determining the number of rollers which hold said sheet on the basis of said detected sheet position and the arrangement of said plurality of rollers; and
  - a speed controller for outputting to said drive source with a designated speed command calculated on the basis of said numbers of rollers, so that the actual sheet transportation speed is always constant regardless to said numbers of rollers.

According to another aspect of the present invention, there is provided an apparatus for controlling a sheet transportation speed, said apparatus comprising:

- a sheet transportation system including a single drive source and a plurality of rollers rotationally driven by said single drive source and arranged in such a manner that a sheet to be transported is held by said rollers one after another;
- means for controlling said single drive source, said means comprising:
  - means for determining the number of rollers which hold said sheet; and a speed controller for providing said drive source with a designated speed calculated on the basis of said numbers of rollers, so that the actual sheet transportation speed is constant regardless to said numbers of rollers.

DESCRIPTION OF THE PREFERRED EMBODIMENTS

Figure 1:
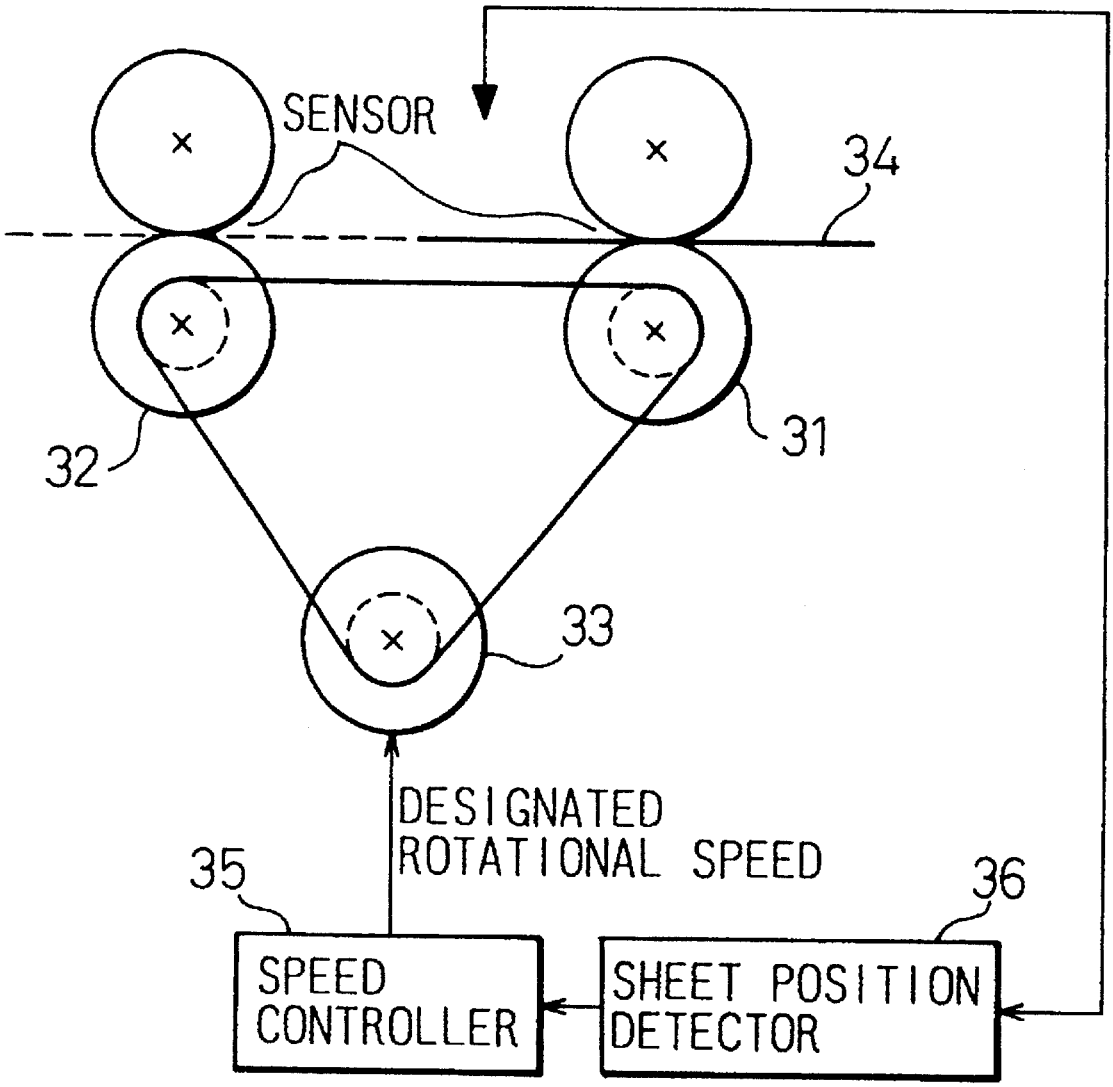
FIG. 1 is a schematic view of a sheet transporting apparatus according to the present invention.

Referring to the drawings, wherein a sheet transporting apparatus of this invention, schematically shown in FIG. 1, comprises a single motor 33, a plurality of feed rollers 31, 32, . . . rotationally driven by the motor 33, and a control means for controlling the motor 33 to control the transportation speed of sheet 34, characterized in that said sheet transporting apparatus comprises a detecting means 36 for detecting the position of the sheet; and a speed controlling means 35 for determining the number of feed rollers which hold the sheet in accordance with a detected sheet position and the predetermined positions where the plurality of rollers are arranged to output a speed command to the motor 33 in accordance with the number of the rollers.

The detecting means 36 detects the position of the sheet 34 which is being transported. The speed controlling means 35 first determines the number of feed rollers which hold the sheet on the basis of a detected sheet position and the predetermined positions where the plurality of rollers are arranged, and then outputs a speed command to the motor 33 in accordance with the number of the rollers. The relationship between the speed command and the number of the rollers can be determined on the basis of experimental results.

Therefore, even though the load of the motor 33 is increased before the speed of the motor 33, and thus the sheet transporting speed, is reduced, the speed command is changed to compensate for the reduction in the sheet transportation speed. Thus, according to the present invention, the actual sheet transportation speed can be maintained constant without any complicated and expensive means, such as a feed-back control means.

Figure 2:
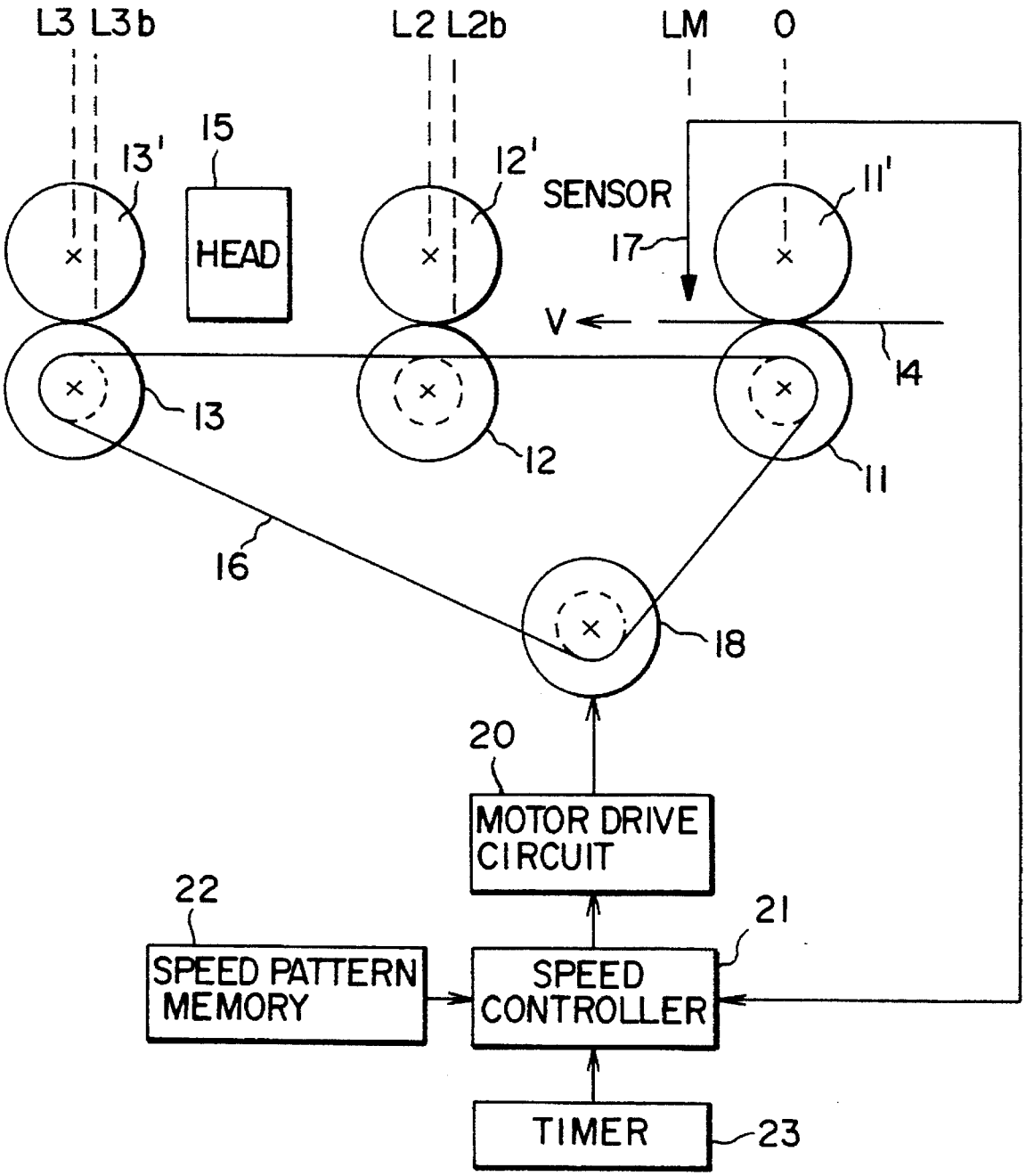
FIG. 2 is a schematic view of an embodiment of sheet transporting apparatus of this invention.
Figure 3:
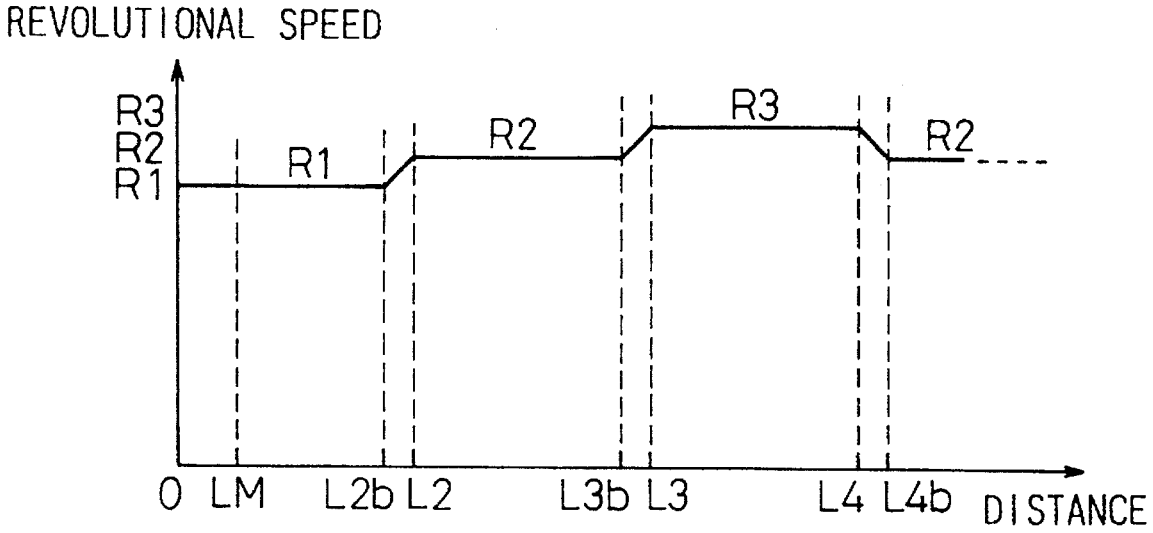
FIG. 3 is a diagram showing an example of the speed pattern in the embodiment.
Figure 4:
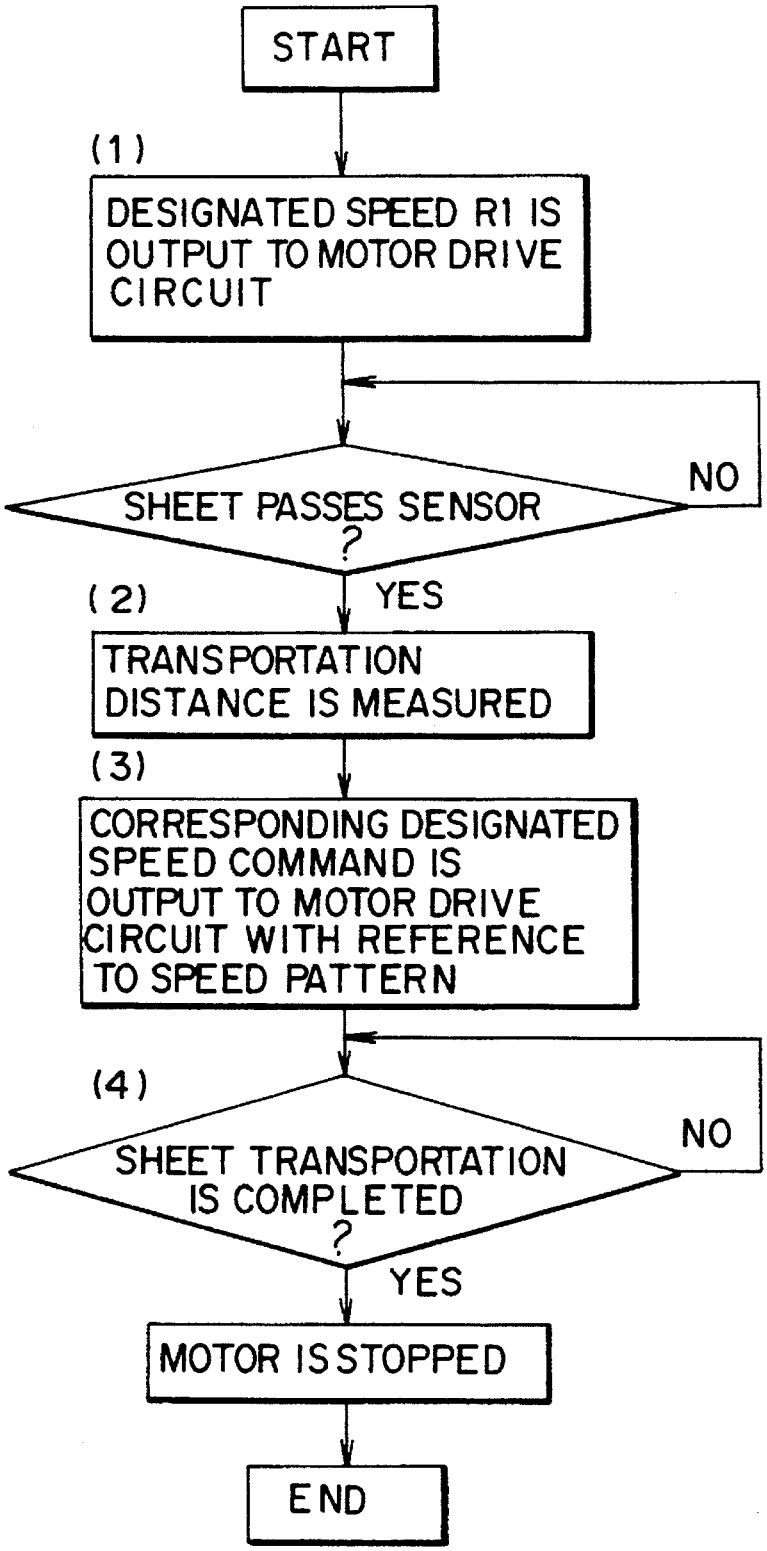
FIG. 4 is a flow diagram showing a control process in the embodiment.
Figure 5A:
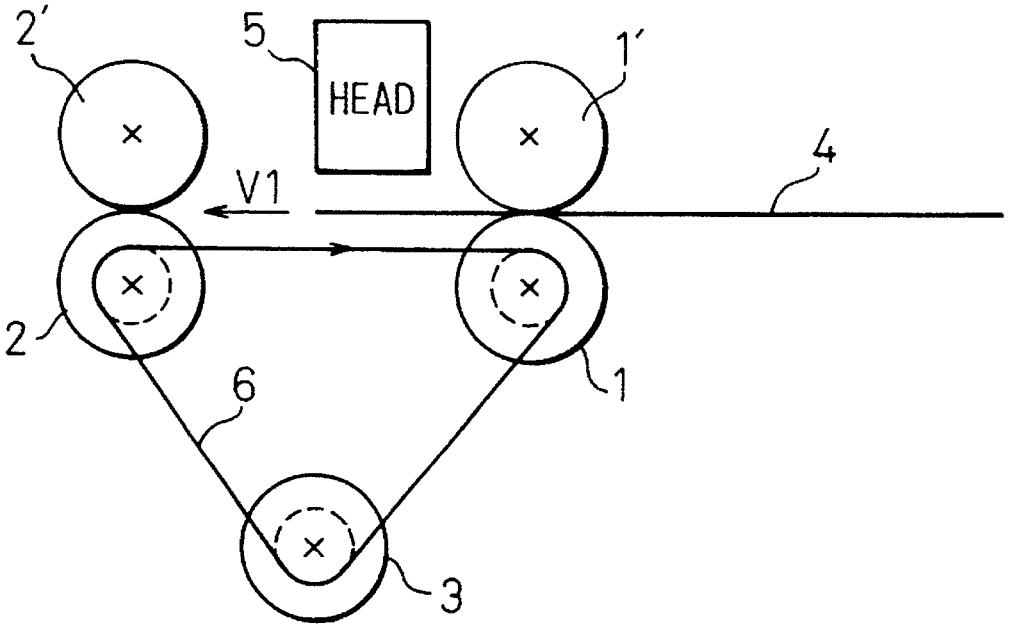
Fig.5A PRIOR ART
FIGS. 5A and 5B are schematic views of sheet transporting apparatuses known in the prior art.
Figure 5B:
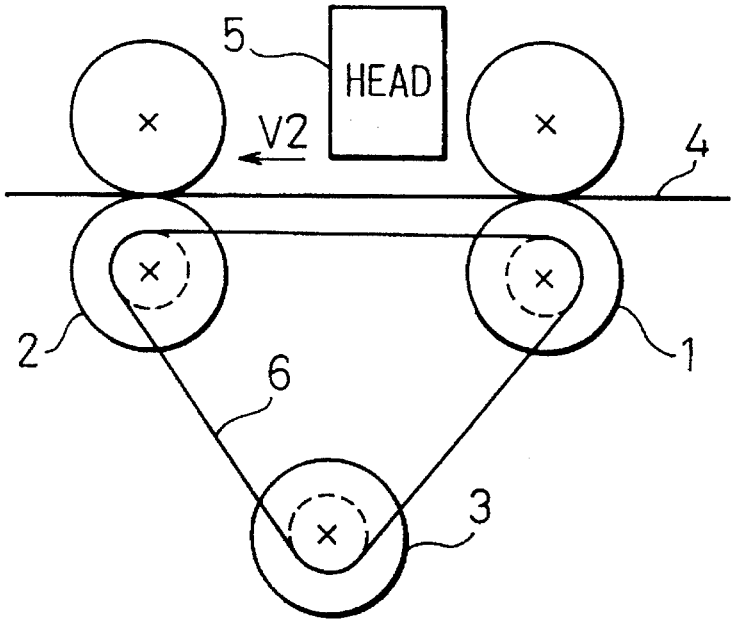
Fig.5B PRIOR ART
Figure 6:
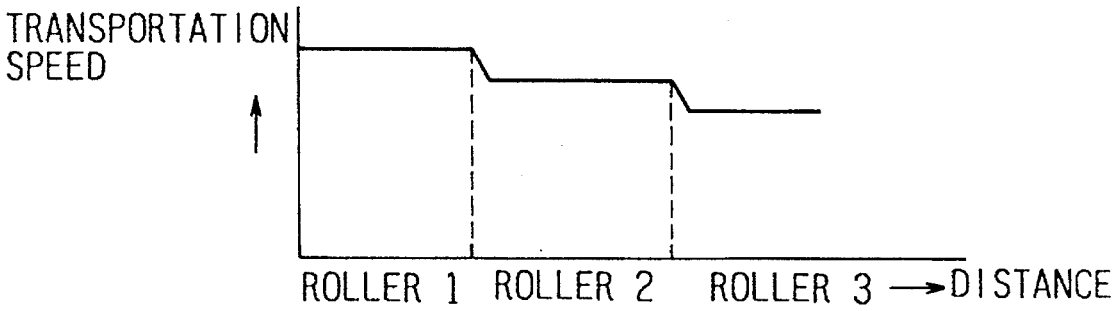
Fig. 6 PRIOR ART
FIG. 6 is a diagram showing an example of the speed pattern in the prior art.

An embodiment of this invention will now be described with reference to FIGS. 2 to 4, wherein FIG. 2 shows an embodiment of a sheet transporting apparatus of this invention, FIG. 3 is a diagram showing an example of the speed pattern in the embodiment, and FIG. 4 is a flow diagram showing a control process in the embodiment.

The embodiment of a sheet transporting apparatus shown in FIG. 2 includes three pairs of rollers 11, 12, and 13, for transporting a sheet 14, each roller having a same diameter. Each of the three pairs of rollers includes a drive roller, and a pinch roller arranged opposite to the drive roller. The three drive rollers 11, 12 and 13 have the same diameter and are operatively connected to a rotating shaft of a motor 18 by means of a belt 16. As shown in FIG. 2, when the motor 18 is rotated, the three drive rollers 11, 12 and 13 rotate at the same speed. Thus, the sheet 14 is first held by and transported by the pair of rollers 11, then by the pair of rollers 12, and then by the pair of rollers 13, at the same predetermined speed.

The motor 18 is preferably a pulse motor or the like. The head 15 is a printing head (or reading head) which is provided at a predetermined position between the rollers 12 and 13 and subjected to a scanning operation in the line direction (i.e., in a direction perpendicular to the drawing).

A position detecting sensor 17 is provided so as to detect the sheet when the leading edge of the sheet 14 arrives at a predetermined position LM (i.e., a distance LM in the direction of transportation from the center of the roller 11).

A motor drive circuit 20 controls the speed of the motor 18 in accordance with the speed command output from a speed controller 21. A speed pattern memory 22 stores the data regarding the designated rotational speeds corresponding to unit times (or unit distances) since the sheet was detected by the sensor 17. The read out address for the designated rotational speed can be accomplished by an address resister, not shown in the drawings, which increments at every read-out time.

A timer 23 outputs the timing signal with a time interval corresponding to the speed pattern stored in the pattern memory 22. The speed controller 21 outputs the speed command to the motor drive circuit 20, i.e., outputs a designated speed command R1 corresponding to the speed V until the sensor detects the paper 14 and then, after the sensor detects the paper 14, the speed controller 21 outputs a designated speed command R2, R3, . . . on the basis of the time lapse (or the distance of transportation) determined by the timing signal output from the timer 23 to the motor drive circuit 20 with reference to the speed pattern memory 22.

An example of the speed pattern is shown in FIG. 3. Such a pattern is determined for the respective kinds (particularly, the width and length) of the sheet 14 in accordance with the positions where the plurality of rollers 1 to 3 are located. Thus, the value of speed in the respective pattern is stored as a designated speed of the motor 18 for transporting the sheet 14 at a constant speed V with respect to the position of the sensor 17.

That is to say, the designated speed is R1 just after the sensor 17 detects the leading edge of the sheet 14 and then the designated speed is changed from R1 to R2 at the time when the leading edge of the sheet 14 is first held by the next roller. Such a timing is calculated from a transportation distance determined by the speed V and the time lapse (time interval read from the pattern) after the leading edge of the sheet 14 is detected by the sensor 17. It can be understood that the difference between R1 and R2 or R3 is a value to compensate for the actual speed reduction due to the number of the rollers which hold the sheet 14.

Although the position where the sheet 14 is held by the roller 12 can be changed due to the thickness of the sheet 14, the pinching pressure of the pair of upper (pinch) and lower (drive) rollers and the like, the position (slightly before the center of the roller 12) at which the sheet 14 comes into contact with the roller 12 is predetermined as L2*b*. Even if the number of the rollers which hold the sheet 14 increases (such as roller contact position L3*b* and transportation distance L3 shown in FIG. 2), such positions are predetermined in the same manner.

The speed pattern is determined in practice on the basis of experimental results and is divided for every unit time lapse to be stored in the speed pattern memory 22. Also the speed pattern is read out for every unit time lapse. Therefore, in the example of FIG. 3, (1) while the sheet 14 is transported by only the roller 11, i.e. until the distance of transportation is L2*b*, a designated revolutional speed R1 is output; (2) during the distance from L2*b*, at which the sheet is started to be transported by the rollers 11 and 12, until L2, i.e., the central position of the roller 12, a designated speed which is linearly accelerated from R1 to R2 is output; (3) after that and until the sheet is held by the roller 13, a designated speed R2 is output; (4) after the sheet is held by the roller 13 and the sheet is transported by the rollers 11, 12, and 13, a designated speed R3 is output.

When the sheet 14 is further transported, the number of rollers which hold the sheet is reduced. Thus, the designated speed is also reduced. Consequently, as shown in FIG. 3, when the transportation distance is calculated as L4, the speed pattern is reduced to R2. In this case, until the transportation distance reaches L4*b*, the designated revolutional speed should steadily decelerate.

FIG. 4 is a flow chart of process for controlling the transportation speed of the sheet 14. The control operation will now be described.

(1) In the first step, the speed controller 21 outputs a designated speed R1 to the motor drive circuit 20 until the leading edge of the sheet 14 arrives at the sensor 17. As a result, the sheet 14 is transported at a speed V until at least after the sheet 14 is held by the rollers 11.

(2) On the basis of the sheet detected signal from the sensor 17, the speed controller 21 starts the timer 23.

(3) Upon every timing signal from the timer 23, the speed controller 21 outputs the corresponding speed command with reference to the speed pattern memory 22.

(4) Thus, the motor 18 is driven in accordance with the predetermined speeds stored in the speed pattern memory 22. When the transportation of the sheet 14 is completed, the motor 18 is stopped. Such a completion of the sheet transportation can be determined by the transportation distance and the length of sheet, or another sheet detecting sensor (not shown).

As mentioned above, according to the sheet transporting apparatus of this invention, the sheet 14 is always transported at a constant speed V. Thus, the printing or reading by the head 15 is significantly improved.

Therefore, according to the present invention, the designated speed of the motor is changed in accordance with the number of the rollers which act to transport the sheet. Consequently, if the number of the rollers which hold the sheet is increased, the designated speed is also increased and, on the other hand, if the number of such rollers is reduced, the designated revolutional speed is also reduced, so that, even if a motor having a relatively small capacity is used, the sheet transportation speed can be maintained at a constant speed.

It will be understood by those skilled in the art that the foregoing description relates to only a preferred embodiment of the disclosed invention, and that various changes and modifications may be made to the invention without departing from the spirit and scope thereof.

For example, in the above-mentioned embodiment, although the speed pattern is recorded and read out on the basis of the time lapse, such a speed pattern may also be recorded on the basis of the units of transportation distance, since the speed V is predetermined and thus the transportation distance can be calculated.

Also, in the above-mentioned embodiment, although a single sensor 17 is provided, additional sensors can be provided at optional positions between the rollers. In this case, the calculated transportation distance can be amended and therefore a more accurate speed control can be attained. In addition, sensors for detecting or measuring the size of sheets can also so be provided and the results can be input to the controller.

We claim:

1. An apparatus for controlling a sheet transportation speed, said apparatus comprising:

a sheet transportation system including a single drive source and a plurality of rollers rotationally driven by said single drive source and arranged in such a manner that a sheet to be transported is held by said rollers one after another;

means for controlling said single drive source, said means comprising:

at least one sensor for detecting a position of said sheet;

number of rollers determining means for determining the number of rollers which hold said sheet on the basis of the sheet position detected by said sensor; and a speed controller means for providing said drive source with a designated speed command calculated on the basis of said number of rollers, said speed controller means compensating for a speed reduction due to the number of rollers so that the actual sheet transportation speed is always constant regardless of said number of rollers.

2. An apparatus as set forth in claim 1, wherein said single drive source is a pulse motor or a direct current motor.

3. An apparatus as set forth in claim 1, wherein the number of rollers determining means determines the number of rollers which hold said sheet on the basis of a time lapse after the leading edge of the sheet is detected by said sensor.

4. An apparatus as set forth in claim 1, wherein the number of rollers determining means determines the number of rollers which hold said sheet on the basis of a transportation distance after the leading edge of the sheet is detected by said sensor.

5. An apparatus as set forth in claim 1, wherein said designated speed command is determined on the basis of a predetermined speed pattern which is calculated, beforehand, according to experimental results.

6. An apparatus for controlling a sheet transportation speed, said apparatus comprising:

a sheet transportation system including a single drive source and a plurality of rollers rotationally driven by said single drive source and arranged in such a manner that a sheet to be transported is held by said rollers one after another;

a means for controlling said single drive source, said means comprising:

number of rollers determining means for determining the number of rollers which hold said sheet; and a speed controller means for providing said drive source with a designated speed calculated on the basis of said number of rollers, said speed controller means compensating for a speed reduction due to the number of rollers so that the actual sheet transportation speed is always constant regardless of said number of rollers.

7. An apparatus as set forth in claim 6, wherein said single drive source is a pulse motor or a direct current motor.

8. An apparatus as set forth in claim 6, wherein the number of rollers determining means determines the number of rollers which hold said sheet on the basis of signals from a plurality of sensors which are arranged at said respective rollers.

9. An apparatus as set forth in claim 6, wherein said designated speed is determined on the basis of a predetermined speed pattern which is calculated, beforehand, according to experimental results.

* * * * *